US010731904B2

(12) United States Patent
Nakajima et al.

(10) Patent No.: US 10,731,904 B2
(45) Date of Patent: Aug. 4, 2020

(54) AIR CONDITIONER

(71) Applicant: Mitsubishi Electric Corporation, Tokyo (JP)

(72) Inventors: Komei Nakajima, Tokyo (JP); Yusuke Tashiro, Tokyo (JP); Yasuhide Hayamaru, Tokyo (JP); Yusuke Adachi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/774,614

(22) PCT Filed: Dec. 2, 2015

(86) PCT No.: PCT/JP2015/083917

§ 371 (c)(1),
(2) Date: May 9, 2018

(87) PCT Pub. No.: WO2017/094147

PCT Pub. Date: Jun. 8, 2017

(65) Prior Publication Data

US 2018/0347875 A1 Dec. 6, 2018

(51) Int. Cl.
*F25B 41/06* (2006.01)
*F25B 49/02* (2006.01)

(52) U.S. Cl.
CPC ..... *F25B 41/062* (2013.01); *F25B 41/067* (2013.01); *F25B 49/02* (2013.01);
(Continued)

(58) Field of Classification Search
CPC ..... F25B 41/062; F25B 41/067; F25B 2700/21162; F25B 2341/0662; F25B 2341/062; F25B 2600/2513
See application file for complete search history.

(56) References Cited

U.S. PATENT DOCUMENTS 3,054,273 A * 9/1962 McGrath ..... F25B 41/062 62/115
4,706,469 A 11/1987 Oguni et al.
6,314,753 B1 11/2001 Hirota et al.
6,532,764 B1 3/2003 Hirota et al.
2013/0186126 A1 7/2013 Morimoto et al.
2013/0192280 A1 8/2013 Kim et al.

FOREIGN PATENT DOCUMENTS

DE 102009009854 A1 * 9/2010
EP 1 202 004 A1 5/2002
(Continued)

OTHER PUBLICATIONS

Nakanishi et al., Expansion Valve and Expansion Valve Unit, Oct. 31, 2001, JP2001304724A, Whole Document (Year: 2001).*
(Continued)

*Primary Examiner* — Larry L Furdge
(74) *Attorney, Agent, or Firm* — Posz Law Group, PLC

(57) ABSTRACT

An air conditioner includes a compressor, a condenser, an expansion valve, an evaporator, and a temperature detection unit. The temperature detection unit is attached to the condenser and is configured to detect a temperature of the refrigerant in the condenser. The expansion valve is configured to be capable of adjusting a flow rate per unit time of the refrigerant flowing through the expansion valve by adjusting a degree of opening of the expansion valve. The degree of opening of the expansion valve is increased when the temperature of the refrigerant detected by the temperature detection unit rises, and the degree of opening of the expansion valve is decreased when the temperature of the refrigerant detected by the temperature detection unit falls.

5 Claims, 8 Drawing Sheets

(52) U.S. Cl.
CPC ... *F25B 2341/062* (2013.01); *F25B 2341/063* (2013.01); *F25B 2341/0662* (2013.01); *F25B 2600/2513* (2013.01); *F25B 2700/21162* (2013.01)

(56) References Cited

FOREIGN PATENT DOCUMENTS

| | | | | |
|---|---|---|---|---|
| JP | S55-20316 | A | | 2/1980 |
| JP | S5520316 | A | * | 2/1980 |
| JP | S56-220 | Y2 | | 1/1981 |
| JP | S56-151858 | A | | 11/1981 |
| JP | S60-142175 | A | | 7/1985 |
| JP | S60-121172 | U | | 8/1985 |
| JP | S62-22975 | A | | 1/1987 |
| JP | H01155166 | A | * | 6/1989 |
| JP | H03-267656 | A | | 11/1991 |
| JP | H09-133436 | A | | 5/1997 |
| JP | 2001-004252 | A | | 1/2001 |
| JP | 2001304724 | A | * | 10/2001 |
| JP | 3517369 | B2 | | 1/2004 |
| JP | 2005076922 | A | * | 3/2005 |
| JP | 2015-067214 | A | | 4/2015 |

OTHER PUBLICATIONS

Nozawa et al., Freezing Cycle, Feb. 13, 1980, JPS5520316A, Whole Document (Year: 1980).*
Yamazaki et al., Air Conditioner, Jun. 19, 1989, JPH01155166A, Whole Document (Year: 1989).*
Roettger, Coolant Water Circuit . . ., Sep. 2, 2010, DE102009009854A1, Whole Document (Year: 2010).*
Ohira et al., Refrigerator, Mar. 24, 2005, JP2005076922A, Whole Document (Year: 2005).*
Office action dated Sep. 5, 2018 issued in corresponding JP patent application No. 2017-184013 (and English translation thereof).
International Search Report of the International Searching Authority dated Mar. 1, 2016 for the corresponding international application No. PCT/JP2015/083917 (and English translation).
Office Action dated Nov. 28, 2017 issued in corresponding JP patent application No. 2017-549352 (and English translation).
Office Action dated Apr. 13, 2018 issued in corresponding JP patent application No. 2017-184013 (and English translation).
Office action dated May 1, 2019 issued in corresponding Australian patent application No. 2015416486.
EP Search Report dated Oct. 18, 2018 issued in corresponding EP patent application No. 15909777.3.
Office Action dated Nov. 4, 2019 issued in corresponding CN patent application No. 201580085152.9 (and English translation).
Office Action dated Jan. 3, 2020 issued in corresponding KR patent application No. 10-2018-7013991 (and English translation).
Office Action dated May 6, 2020 issued in corresponding IN patent application No. 201847018298 (and English translation).
Office Action dated Jun. 17, 2020 issued in corresponding Korean patent application No. KR 10-2018-7013991(and English translation).

* cited by examiner

AIR CONDITIONER

CROSS REFERENCE TO RELATED APPLICATION

This application is a U.S. national stage application of PCT/JP2015/083917 filed on Dec. 2, 2015, the contents of which are incorporated herein by reference.

TECHNICAL FIELD

The present invention relates to an air conditioner, and in particular to an air conditioner in which the degree of opening of an expansion valve is increased and decreased.

BACKGROUND ART

When an outdoor air temperature is high, required cooling capability in cooling operation of an air conditioner increases, and thus it is required to increase a flow rate of refrigerant which circulates through the air conditioner. On the other hand, when the outdoor air temperature is low, required cooling capability in the cooling operation of the air conditioner decreases, and thus it is required to decrease the flow rate of the refrigerant which circulates through the air conditioner. That is, in the cooling operation of the air conditioner, it is required to appropriately adjust the flow rate of the refrigerant which circulates through the air conditioner in accordance with the outdoor air temperature.

Further, conventionally, air conditioners in which the degree of opening of an expansion valve is adjustable have been proposed. For example, Japanese Patent Laying-Open No. 56-151858 (PTD 1) discloses, as conventional art, a supercooling control device for a refrigerator as an expansion valve whose degree of opening is adjustable. In this supercooling control device for a refrigerator, the temperature of refrigerant at an outlet of a condenser is detected as thermal change by a temperature sensitive cylinder attached to an outlet pipe. This thermal change is converted into pressure change of a heated medium enclosed in the temperature sensitive cylinder. A diaphragm is displaced by this pressure change, and thereby a valve body connected to the diaphragm is displaced. A gap between the valve body and a valve seat is adjusted by the displacement of the valve body. Thereby, a throttle amount of the valve is adjusted.

CITATION LIST

Patent Document

PTD 1: Japanese Patent Laying-Open No. 56-151858

SUMMARY OF INVENTION

Technical Problem

However, in the supercooling control device for a refrigerator described in the above publication, the throttle amount of the valve is adjusted to maintain a constant degree of supercooling. Therefore, the throttle amount of the valve is increased when the temperature of the refrigerant at the outlet of the condenser is high, and the throttle amount of the valve is decreased when the temperature of the refrigerant at the outlet of the condenser is low. Since the outdoor air temperature is proportional to a condensation temperature, in this supercooling control device for a refrigerator, it is not possible to increase the flow rate of the refrigerant when the outdoor air temperature is high, and decrease the flow rate of the refrigerant when the outdoor air temperature is low.

The present invention has been made in view of the aforementioned problem, and an object of the present invention is to provide an air conditioner capable of increasing an amount of refrigerant which circulates through the air conditioner when an outdoor air temperature is high, and decreasing the amount of the refrigerant which circulates through the air conditioner when the outdoor air temperature is low.

Solution to Problem

An air conditioner of the present invention includes a compressor, a condenser, an expansion valve, an evaporator, and a temperature detection unit. The compressor is configured to compress refrigerant. The condenser is configured to condense the refrigerant compressed by the compressor. The expansion valve is configured to decompress the refrigerant condensed by the condenser. The evaporator is configured to evaporate the refrigerant decompressed by the expansion valve. The temperature detection unit is attached to the condenser and is configured to detect a temperature of the refrigerant in the condenser. The expansion valve is configured to be capable of adjusting a flow rate per unit time of the refrigerant flowing through the expansion valve by adjusting a degree of opening of the expansion valve. The degree of opening of the expansion valve is increased when the temperature of the refrigerant detected by the temperature detection unit rises, and the degree of opening of the expansion valve is decreased when the temperature of the refrigerant detected by the temperature detection unit falls.

Advantageous Effects of Invention

According to the air conditioner of the present invention, the temperature detection unit detects the temperature of the refrigerant in the condenser. Then, the degree of opening of the expansion valve is increased when the temperature of the refrigerant detected by the temperature detection unit rises, and the degree of opening of the expansion valve is decreased when the temperature of the refrigerant detected by the temperature detection unit falls. The temperature of the refrigerant in the condenser is proportional to an outdoor air temperature. Therefore, the temperature of the refrigerant detected by the temperature detection unit increases when the outdoor air temperature is high, and the temperature of the refrigerant detected by the temperature detection unit decreases when the outdoor air temperature is low. Accordingly, the degree of opening of the expansion valve can be increased when the outdoor air temperature is high, and the degree of opening of the expansion valve can be decreased when the outdoor air temperature is low. Thereby, an amount of the refrigerant which circulates through the air conditioner can be increased when the outdoor air temperature is high, and the flow rate of the refrigerant which circulates through the air conditioner can be decreased when the outdoor air temperature is low.

DESCRIPTION OF EMBODIMENTS

Hereinafter, embodiments of the present invention will be described based on the drawings.

First Embodiment

Figure 1:
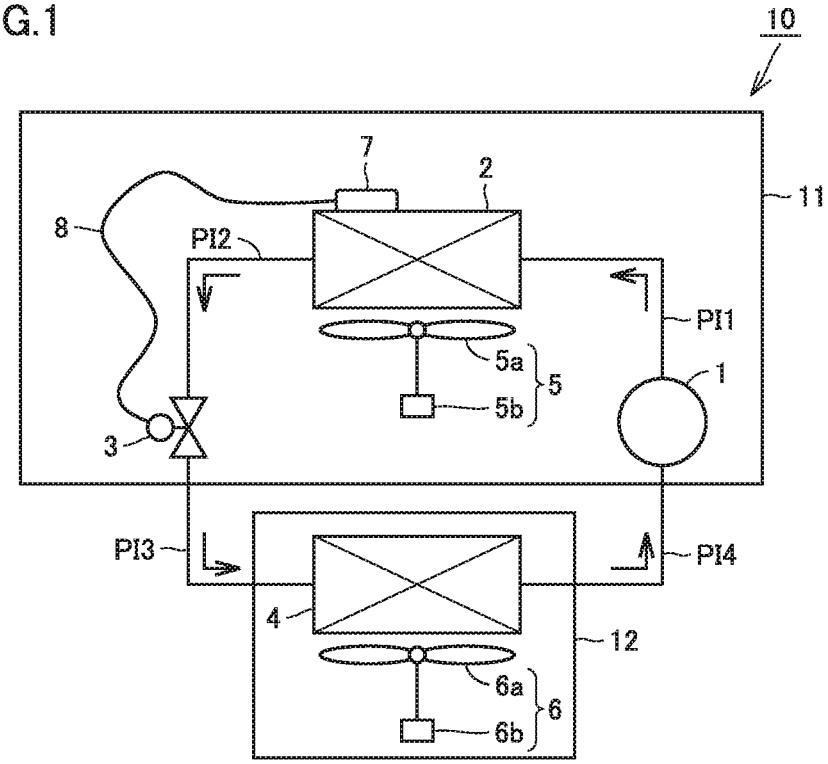
FIG. 1 is a view schematically showing a structure of a refrigeration cycle of an air conditioner in a first embodiment of the present invention.

FIG. 1 is a structural drawing of a refrigeration cycle of an air conditioner in a first embodiment of the present invention. First, referring to FIG. 1, a configuration of an air conditioner 10 in the first embodiment of the present invention will be described.

Air conditioner 10 of the present embodiment mainly has a compressor 1, a condenser 2, an expansion valve 3, an evaporator a condenser blower 5, an evaporator blower 6, a temperature detection unit 7, a tube 8, and pipes PI1 to PI4. Compressor 1, condenser 2, expansion valve 3, condenser blower 5, temperature detection unit 7, and tube 8 are housed in an outdoor unit 11. Evaporator 4 and evaporator blower 6 are housed in an indoor unit 12.

Compressor 1, condenser 2, expansion valve 3, and evaporator 4 communicate via pipes PI1 to PI4 and thereby constitute a refrigeration cycle. Specifically, compressor 1 and condenser 2 are connected with each other by pipe PI1. Condenser 2 and expansion valve 3 are connected with each other by pipe PI2. Expansion valve 3 and evaporator 4 are connected with each other by pipe PI3. Evaporator 4 and compressor 1 are connected with each other by pipe PI4. The refrigeration cycle is configured such that refrigerant circulates in order of compressor 1, pipe PI1, condenser 2, pipe PI2, expansion valve 3, pipe PI3, evaporator 4, and pipe PI4. As the refrigerant, for example, R410a, R32, R1234yf, or the like can be used.

Compressor 1 is configured to compress the refrigerant. Further, compressor 1 is configured to compress the sucked refrigerant and discharge the compressed refrigerant. Compressor 1 is configured to have a variable capacity. Compressor 1 of the present embodiment is configured such that its rotation number is variably controllable. Specifically, the rotation number of compressor 1 is adjusted by changing a drive frequency of compressor 1 based on an instruction from a control device not shown. Thereby, the capacity of compressor 1 is changed. This capacity of compressor 1 is an amount of discharging the refrigerant per unit time. That is, compressor 1 can perform high capacity operation and low capacity operation. In the high capacity operation, the operation is performed with a flow rate of the refrigerant which circulates through a refrigerant circuit being increased by increasing the drive frequency of compressor 1. In the low capacity operation, the operation is performed with the flow rate of the refrigerant which circulates through the refrigerant circuit being decreased by decreasing the drive frequency of compressor 1.

Condenser 2 is configured to condense the refrigerant compressed by compressor 1. Condenser 2 is an air heat exchanger including a pipe and a fin. Expansion valve 3 is configured to decompress the refrigerant condensed by condenser 2. Expansion valve 3 is configured to be capable of adjusting the flow rate of the refrigerant flowing through expansion valve 3 by adjusting the degree of opening of expansion valve 3. This flow rate of the refrigerant flowing through expansion valve 3 is a flow rate per unit time. Evaporator 4 is configured to evaporate the refrigerant decompressed by expansion valve 3. Evaporator 4 is an air heat exchanger including a pipe and a fin.

Condenser blower 5 is configured to adjust an amount of heat exchange between outdoor air and the refrigerant in condenser 2. Condenser blower 5 includes a fan 5*a* and a motor 5*b*. Motor 5*b* may be configured to rotate fan 5*a* at a variable rotation number. Motor 5*b* may also be configured to rotate fan 5*a* at a constant rotation number. Evaporator blower 6 is configured to adjust an amount of heat exchange between indoor air and the refrigerant in evaporator 4. Evaporator blower 6 includes a fan 6*a* and a motor 6*b*. Motor 6*b* may be configured to rotate fan 6*a* at a variable rotation number. Motor 6*b* may also be configured to rotate fan 6*a* at a constant rotation number.

Temperature detection unit 7 is attached to condenser 2. Temperature detection unit 7 is configured to detect the temperature of the refrigerant in condenser 2. Temperature detection unit 7 is connected to expansion valve 3 via tube 8. The degree of opening of expansion valve 3 is increased when the temperature of the refrigerant detected by temperature detection unit 7 rises, and the degree of opening of expansion valve 3 is decreased when the temperature of the refrigerant detected by temperature detection unit 7 falls. Temperature detection unit 7 detects the temperature of the refrigerant in a state before the refrigerant is condensed and liquefied in condenser 2. Temperature detection unit 7 is provided at a location in condenser 2 where it can detect a condensation temperature of the refrigerant. Accordingly, temperature detection unit 7 may be provided at an inlet part of condenser 2, or at an intermediate part between an inlet and an outlet of condenser 2.

Figure 2:
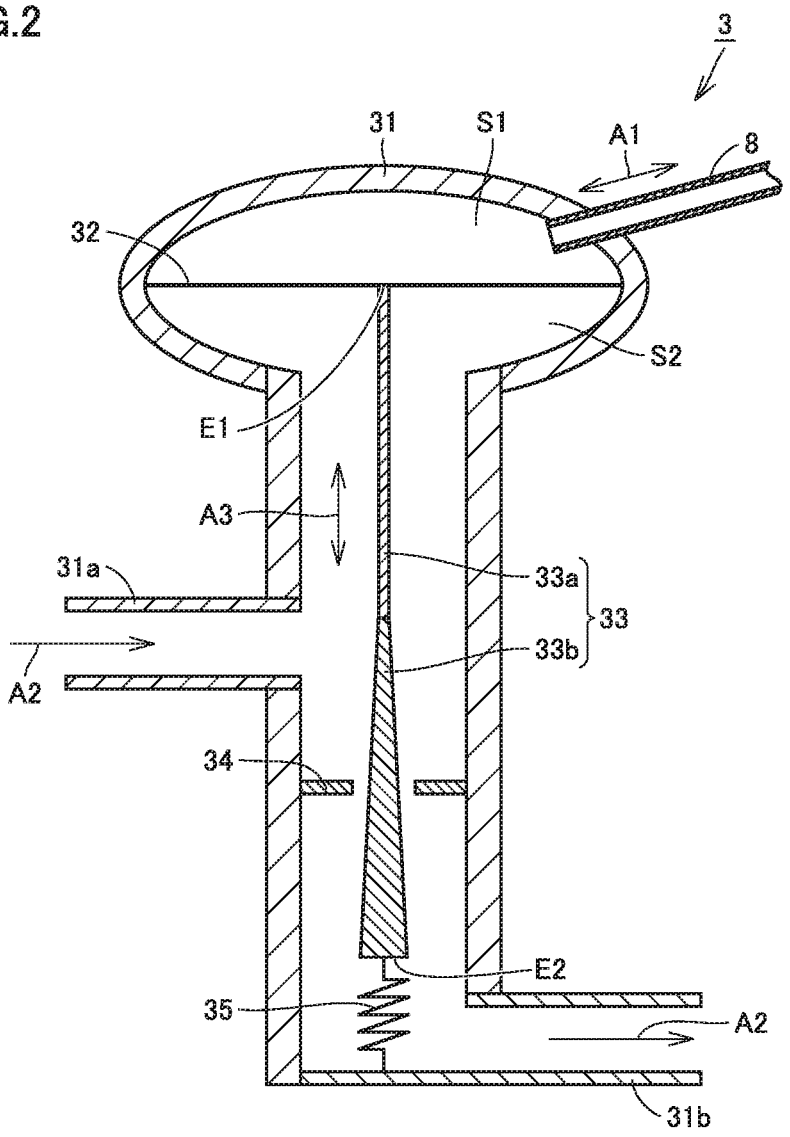
FIG. 2 is a cross sectional view schematically showing a structure of an expansion valve of the air conditioner in the first embodiment of the present invention.

Referring to FIGS. 1 and 2, configurations of specific examples of expansion valve 3 and temperature detection unit 7 in the present embodiment will be described in detail.

Expansion valve 3 is a temperature-type expansion valve. Expansion valve 3 serving as a temperature-type expansion valve is configured such that its degree of opening is adjusted in accordance with a change in the temperature of the refrigerant in condenser 2. Temperature detection unit 7 is a temperature sensitive cylinder. In temperature detection unit 7 serving as a temperature sensitive cylinder, refrigerant having the same properties as those of the refrigerant used for a refrigerant cycle is enclosed.

Expansion valve 3 has a case 31, a diaphragm 32, a valve body 33, a valve seat 34, and a spring 35. Diaphragm 32 is attached inside case 31 to partition the inside of case 31. Case 31 has a first chamber S1 and a second chamber S2 partitioned by diaphragm 32.

Tube 8 is inserted into first chamber S1. First chamber S1 is configured such that the refrigerant enclosed in temperature detection unit 7 serving as a temperature sensitive cylinder can flow into and out of first chamber S1 via tube 8. That is, the refrigerant enclosed in temperature detection unit 7 serving as a temperature sensitive cylinder flows into and out of first chamber S1 through tube 8, as indicated by a double-headed arrow A1 in FIG. 2.

Valve body 33, valve seat 34, and spring 35 are housed in second chamber S2. Second chamber S2 has an inflow portion 31*a* and an outflow portion 31*b*. Inflow portion 31*a* is connected to pipe PI2. Outflow portion 31*b* is connected to pipe PI3. Second chamber S2 is configured such that the refrigerant flowing through the refrigeration cycle flows from pipe PI2 through inflow portion 31*a* into second chamber S2, and flows out through outflow portion 31*b* into pipe PI3. That is, as indicated by arrows A2 in FIG. 2, the refrigerant flowing through the refrigeration cycle flows from inflow portion 31*a* into second chamber S2, and flows out of outflow portion 31*b*.

The pressure of first chamber S1 is equal to the pressure of the refrigerant enclosed in temperature detection unit 7 serving as a temperature sensitive cylinder. The pressure of second chamber S2 is equal to the pressure of the refrigerant flowing through the refrigeration cycle. Diaphragm 32 is configured to be deformable by a differential pressure between the pressure of first chamber S1 and the pressure of second chamber S2.

Valve body 33 has a first end E1, a second end E2, a shaft portion 33*a*, and a tapered portion 33*b*. First end E1 is connected to diaphragm 32. Second end E2 is connected to spring 35. Shaft portion 33*a* and tapered portion 33*b* extend in an axial direction of valve body 33. The axial direction of valve body 33 is a direction in which first end E1 and second end E2 are opposed to each other, as indicated by an arrow A3 in FIG. 2.

Shaft portion 33*a* has first end E1. Tapered portion 33*b* has second end E2. Shaft portion 33*a* is connected to tapered portion 33*b* on a side opposite to first end E1 in an axial direction A3. Tapered portion 33*b* is configured such that its cross sectional area continuously increases from shaft portion 33*a* toward second end E2. Valve body 33 is configured to move in axial direction A3 due to deformation of diaphragm 32.

A gap is provided between tapered portion 33*b* of valve body 33 and valve seat 34. Expansion valve 3 is configured such that the size of the gap between tapered portion 33*b* and valve seat 34 is continuously changed by movement of valve body 33 in axial direction A3 due to deformation of diaphragm 32. That is, expansion valve 3 is configured such that a throttle amount of expansion valve 3 changes in proportion to an amount of movement of valve body 33 in axial direction A3.

Specifically, expansion valve 3 is configured such that the gap between tapered portion 33*b* and valve seat 34 is decreased when valve body 33 moves to a first end E1 side in axial direction A3. That is, expansion valve 3 is configured such that the throttle amount of expansion valve 3 is increased when valve body 33 moves to the first end E1 side in axial direction A3. On the other hand, expansion valve 3 is configured such that the gap between tapered portion 33*b* and valve seat 34 is increased when valve body 33 moves to a second end E2 side in axial direction A3. That is, expansion valve 3 is configured such that the throttle amount of expansion valve 3 is decreased when valve body 33 moves to the second end E2 side in axial direction A3.

Valve seat 34 is attached inside case 31. Valve seat 34 is placed between inflow portion 31*a* and outflow portion 31*b*, in a flow path extending from inflow portion 31*a* to outflow portion 31*b*. Valve seat 34 is placed on the outside of tapered portion 33*b* of valve body 33.

Spring 35 is connected to second end E2 of valve body 33 and a bottom portion of case 31. Spring 35 is configured to bias valve body 33 by an elastic force.

Next, a flow of the refrigerant in the refrigeration cycle of air conditioner 10 of the present embodiment will be described.

Referring to FIG. 1, the refrigerant flowing into compressor 1 is compressed by compressor 1, and becomes high-temperature high-pressure gas refrigerant. The high-temperature high-pressure gas refrigerant discharged from compressor 1 flows through pipe PI1 into condenser 2 serving as a radiator. The refrigerant flowing into condenser 2 exchanges heat with the air in condenser 2. Specifically, in condenser 2, the refrigerant is condensed by heat radiation into the air, and the air is heated by the refrigerant. High-pressure liquid refrigerant condensed by condenser 2 flows through pipe PI2 into expansion valve 3.

The refrigerant flowing into expansion valve 3 is decompressed by expansion valve 3, and becomes low-pressure gas-liquid two-phase refrigerant. The refrigerant decompressed by expansion valve 3 flows through pipe PI3 into evaporator 4. The refrigerant flowing into evaporator 4 exchanges heat with the air in evaporator 4. Specifically, in evaporator 4, the air is cooled by the refrigerant, and the refrigerant becomes low-pressure gas refrigerant. The refrigerant which is decompressed and becomes low-pressure gas in evaporator 4 flows through pipe PI4 into compressor 1. The refrigerant flowing into compressor 1 is compressed again and pressurized, and then is discharged from compressor 1.

Figure 3:
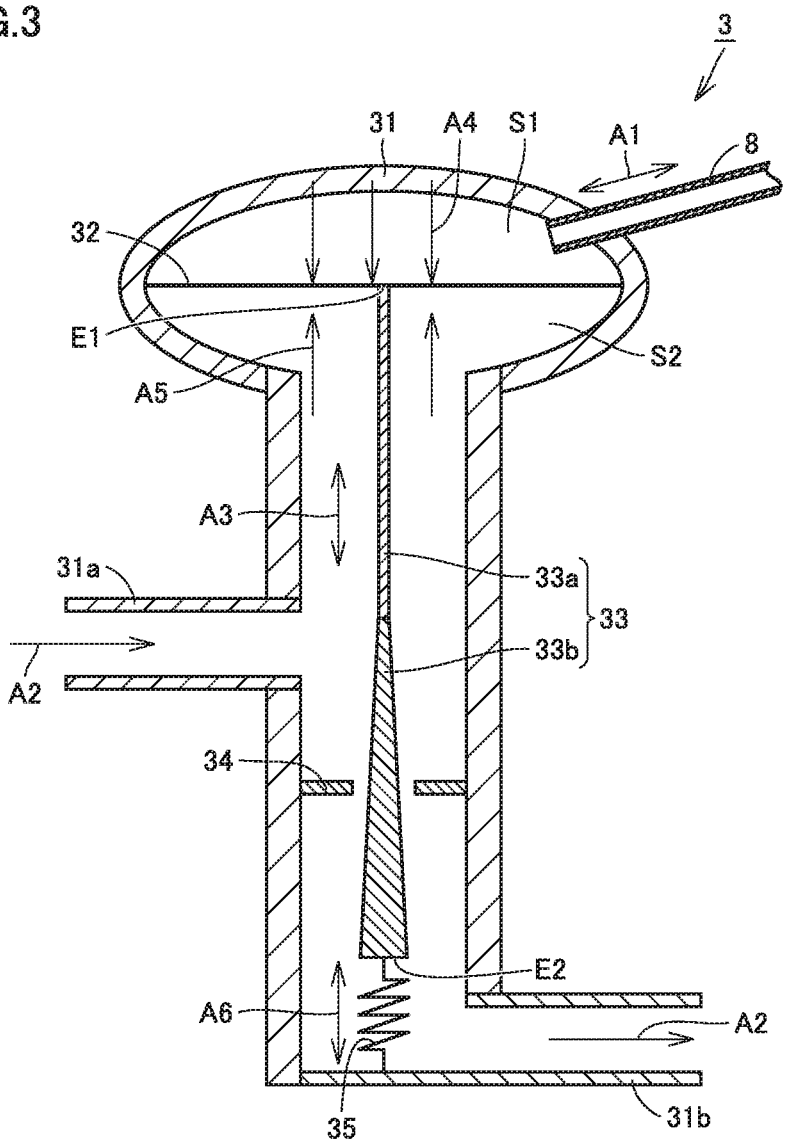
FIG. 3 is a cross sectional view for illustrating operation of the expansion valve of the air conditioner in the first embodiment of the present invention.

Subsequently, referring to FIGS. 2 and 3, operations of the specific examples of expansion valve 3 and temperature detection unit 7 in the present embodiment will be described in detail.

Diaphragm 32 is deformed by the differential pressure between a pressure A4 of first chamber S1 (an internal pressure of temperature detection unit 7 serving as a temperature sensitive cylinder) of case 31 and a pressure A5 of second chamber S2 (pressure of the refrigerant condensed by condenser 2).

When the temperature of the refrigerant enclosed in temperature detection unit 7 serving as a temperature sensitive cylinder increases, the pressure of first chamber S1 of case 31 becomes higher than the pressure of second chamber S2. When the pressure of first chamber S1 of case 31 becomes higher than the pressure of second chamber S2, diaphragm 32 is deformed to be convex toward second chamber S2. Due to this deformation of diaphragm 32, valve body 33 moves to the second end E2 side in axial direction A3. Accordingly, the gap between tapered portion 33*b* and valve seat 34 is increased. That is, the throttle amount of expansion valve 3 is decreased. Thereby, an amount of the refrigerant flowing through expansion valve 3 is increased.

On the other hand, when the temperature of the refrigerant enclosed in temperature detection unit 7 serving as a temperature sensitive cylinder decreases, the pressure of first chamber S1 of case 31 becomes lower than the pressure of second chamber S2. When the pressure of first chamber S1 of case 31 becomes lower than the pressure of second chamber S2, diaphragm 32 is deformed to be convex toward first chamber S1. Due to this deformation of diaphragm 32, valve body 33 moves to the first end E1 side in axial direction A3. Accordingly, the gap between tapered portion 33*b* and valve seat 34 is decreased. That is, the throttle amount of expansion valve 3 is increased. Thereby, the amount of the refrigerant flowing through expansion valve 3 is decreased.

Further, the amount of movement of valve body 33 in axial direction A3 is determined by the pressure of the refrigerant enclosed in temperature detection unit 7 which flows into first chamber S1, the pressure of the refrigerant in the refrigeration cycle which flows into second chamber S2, and a bias force A6 of spring 35 connected to valve body 33.

Next, the relation between an operation state of the refrigeration cycle and the throttle amount wilt be described.

Figure 4:
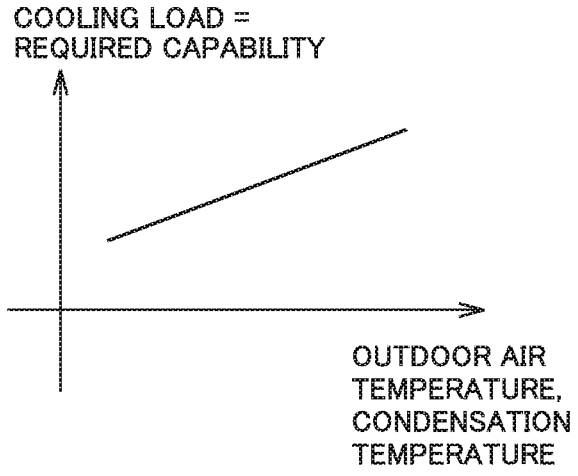
FIG. 4 is a view showing the relation between a cooling load and an outdoor air temperature.

Cooling capability required for the refrigeration cycle is determined by an outdoor air temperature. This is because, when the outdoor air temperature increases, an indoor air temperature increases in proportion to the increase of the outdoor air temperature, and thereby more cooling capability is required. Therefore, as shown in FIG. 4, the outdoor air temperature and the cooling capability (cooling load=required capability) have a proportional relation. Since the increase of the outdoor air temperature and the increase of the condensation temperature have a proportional relation, it can be considered that the axis of abscissas of FIG. 4 also represents the condensation temperature. This also applies to FIGS. 5 and 6.

Figure 5:
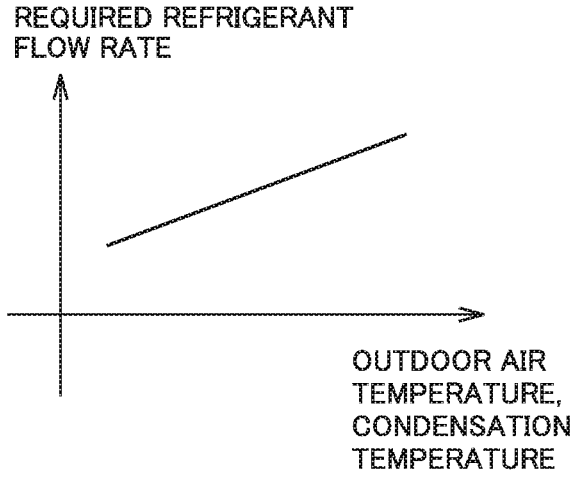
FIG. 5 is a view showing the relation between a required refrigerant flow rate and the outdoor air temperature.

Further, the cooling capability is proportional to a refrigerant flow rate Gr of the refrigerant flowing into the refrigeration cycle. This can also be explained from the fact that cooling capability Qe is expressed by Qe=Gr×Δhe, using a specific enthalpy difference Δhe of the refrigerant at an inlet and an outlet of the evaporator. Therefore, as shown in FIG. 5, the outdoor air temperature and a circulation flow rate (required refrigerant flow rate) have a proportional relation.

Further, the throttle amount required for a temperature-type expansion valve can be expressed by a flow rate coefficient (Cv value). This Cv is expressed by the following equation (1), using refrigerant circulation flow rate Gr, a condensation pressure P1, an evaporation pressure P2, and a refrigerant density ρl at an inlet of the expansion valve.

$$Cv = Gr\sqrt{\frac{1}{\rho l(P1 - P2)}} \tag{1}$$

Figure 6:
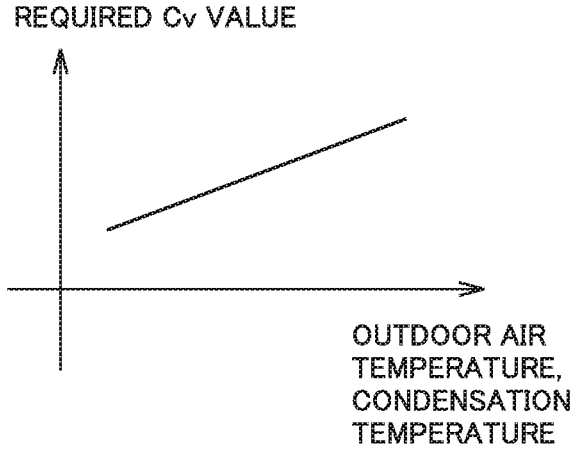
FIG. 6 is a view showing the relation between a required Cv value and the outdoor air temperature.

As expressed in equation (1), the refrigerant flow rate and the Cv value have a proportional relation. Therefore, as shown in FIG. 6, the refrigerant flow rate and the Cv value (required Cv value) have a proportional relation.

In air conditioner 10 of the present embodiment, the flow rate coefficient of expansion valve 3 is increased when the temperature of the refrigerant detected by temperature detection unit 7 rises, and the flow rate coefficient of expansion valve 3 is decreased when the temperature of the refrigerant detected by temperature detection unit 7 falls.

Next, the function and effect of the present embodiment will be described.

According to air conditioner 10 of the present embodiment, temperature detection unit 7 detects the temperature of the refrigerant in condenser 2. Then, the degree of opening of expansion valve 3 is increased when the temperature of the refrigerant detected by temperature detection unit 7 rises, and the degree of opening of expansion valve 3 is decreased when the temperature of the refrigerant detected by temperature detection unit 7 falls. The temperature of the refrigerant in condenser 2 is proportional to the outdoor air temperature. Therefore, the temperature of the refrigerant detected by temperature detection unit 7 increases when the outdoor air temperature is high, and the temperature of the refrigerant detected by temperature detection unit 7 decreases when the outdoor air temperature is low. Accordingly, the degree of opening of expansion valve 3 can be increased when the outdoor air temperature is high, and the degree of opening of expansion valve 3 can be decreased when the outdoor air temperature is low. Thereby, the amount of the refrigerant which circulates through air conditioner 10 can be increased when the outdoor air temperature is high, and the flow rate of the refrigerant which circulates through air conditioner 10 can be decreased when the outdoor air temperature is low. Consequently, the flow rate of the refrigerant which circulates through air conditioner 10 can be adjusted appropriately in accordance with the outdoor air temperature, in the cooling operation of air conditioner 10.

Further, in air conditioner 10 of the present embodiment, the throttle amount of expansion valve 3 can be changed in accordance with the temperature of the refrigerant in condenser 2. Accordingly, an increase in a discharge temperature at which the refrigerant is discharged from compressor 1 can be suppressed, when compared with a case where a capillary having a fixed throttle amount is used as an expansion valve. Therefore, failure of compressor 1 due to an increase in the discharge temperature at which the refrigerant is discharged from compressor 1 can be suppressed.

Further, in air conditioner 10 of the present embodiment, the throttle amount of expansion valve 3 can be changed in accordance with the temperature of the refrigerant in condenser 2. Accordingly, the refrigerant at the outlet of evaporator 4 can be controlled to be in a state close to the state of saturated gas, by adjusting the degree of superheat, which is determined by a difference between a temperature of the refrigerant at the outlet of evaporator 4 and a temperature of the refrigerant inside evaporator 4, to about 1K to 5K. Therefore, the refrigerant to be sucked into compressor 1 can be controlled to be in the state close to the state of saturated gas. Accordingly, performance of compressor 1 can be improved, when compared with the case where a capillary having a fixed throttle amount is used as an expansion valve.

Further, in air conditioner 10 of the present embodiment, the throttle amount of expansion valve 3 can be changed in accordance with the temperature of the refrigerant in condenser 2. Accordingly, the degree of supercooling at the outlet of condenser 2 can be secured. Therefore, noise caused by a gaseous phase flowing into the inlet of expansion valve 3 can be reduced.

Further, in air conditioner 10 of the present embodiment, the throttle amount of expansion valve 3 can be changed in accordance with the temperature of the refrigerant in condenser 2. Accordingly, high pressure of condenser 2 can be controlled. Therefore, there is no need to make the rotation number of fan 5*a* of condenser blower 5 variable in order to control the high pressure of condenser 2. Consequently, a fixed blower in which the rotation number of fan 5*a* is constant can be used as condenser blower 5.

Further, in a case where refrigerant having a high discharge temperature (for example, R410a, R32, R1234yf, or the like) is used, when temperature detection unit 7 is attached at the outlet of evaporator 4, it is not possible to decrease the temperature under a condition where the discharge temperature increases, such as an overload condition, in order to maintain a constant degree of superheat. In contrast, in air conditioner 10 of the present embodiment, since temperature detection unit 7 is attached to condenser 2 and operation can be performed with the refrigerant to be sucked into compressor 1 being in a gas-liquid two-phase state, the discharge temperature can be decreased. As a result, failure of compressor 1 can be prevented even in the case where the above refrigerant having a high discharge temperature is used.

In air conditioner 10 of the present embodiment, expansion valve 3 is a temperature-type expansion valve, and temperature detection unit 7 is a temperature sensitive cylinder. Accordingly, a temperature-type expansion valve can be used as expansion valve 3, and a temperature sensitive cylinder can be used as temperature detection unit 7. Therefore, the size and the cost of air conditioner 10 can be reduced, when compared with a case where an electronic expansion valve is used. That is, in the case where an electronic expansion valve is used, an electronic substrate for driving the electronic expansion valve is required, and thus it is necessary to secure a space for installing the electronic substrate. Accordingly, the size of air conditioner 10 is increased. In addition, since an actuator for driving the electronic expansion valve and the like are required, the cost of air conditioner 10 is increased. In contrast, in air conditioner 10 of the present embodiment, since a temperature-type expansion valve can be used as expansion valve 3, and a temperature sensitive cylinder can be used as temperature detection unit 7, the size and the cost of air conditioner 10 can be reduced, when compared with the case where an electronic expansion valve is used.

In air conditioner 10 of the present embodiment, the rotation number of compressor 1 is variably controllable. Accordingly, the cooling capability can be changed by variably controlling the rotation number of compressor 1. Therefore, in a state where the cooling capability is changed by variably controlling the rotation number of compressor 1, the amount of the refrigerant which circulates through air conditioner 10 can be increased when the outdoor air temperature is high, and the flow rate of the refrigerant which circulates through air conditioner 10 can be decreased when the outdoor air temperature is low.

In air conditioner 10 of the present embodiment, the flow rate coefficient of expansion valve 3 is increased when the temperature of the refrigerant detected by temperature detection unit 7 rises, and the flow rate coefficient of expansion valve 3 is decreased when the temperature of the refrigerant detected by temperature detection unit 7 falls. Accordingly, expansion valve 3 can be adjusted in accordance with a change in flow rate coefficient.

In air conditioner 10 of the present embodiment, temperature detection unit 7 detects the temperature of the refrigerant in a state before the refrigerant is condensed and liquefied in condenser 2. Accordingly, the temperature of the refrigerant which is proportional to the outdoor air temperature can be accurately detected. Therefore, the flow rate of the refrigerant which circulates through air conditioner 10 can be accurately adjusted in accordance with the outdoor air temperature.

Second Embodiment

Hereinafter, components identical to those in the first embodiment will be designated by the same reference numerals, and the description thereof will not be repeated, unless otherwise specified.

Figure 7:
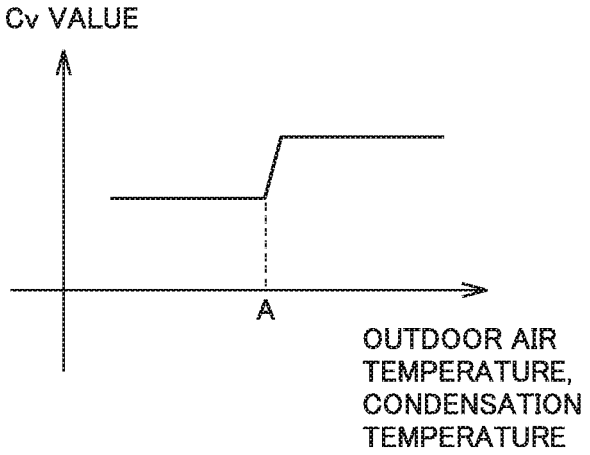
FIG. 7 is a view showing the relation between a Cv value of an expansion valve of an air conditioner in a second embodiment of the present invention and the outdoor air temperature.
Figure 8:
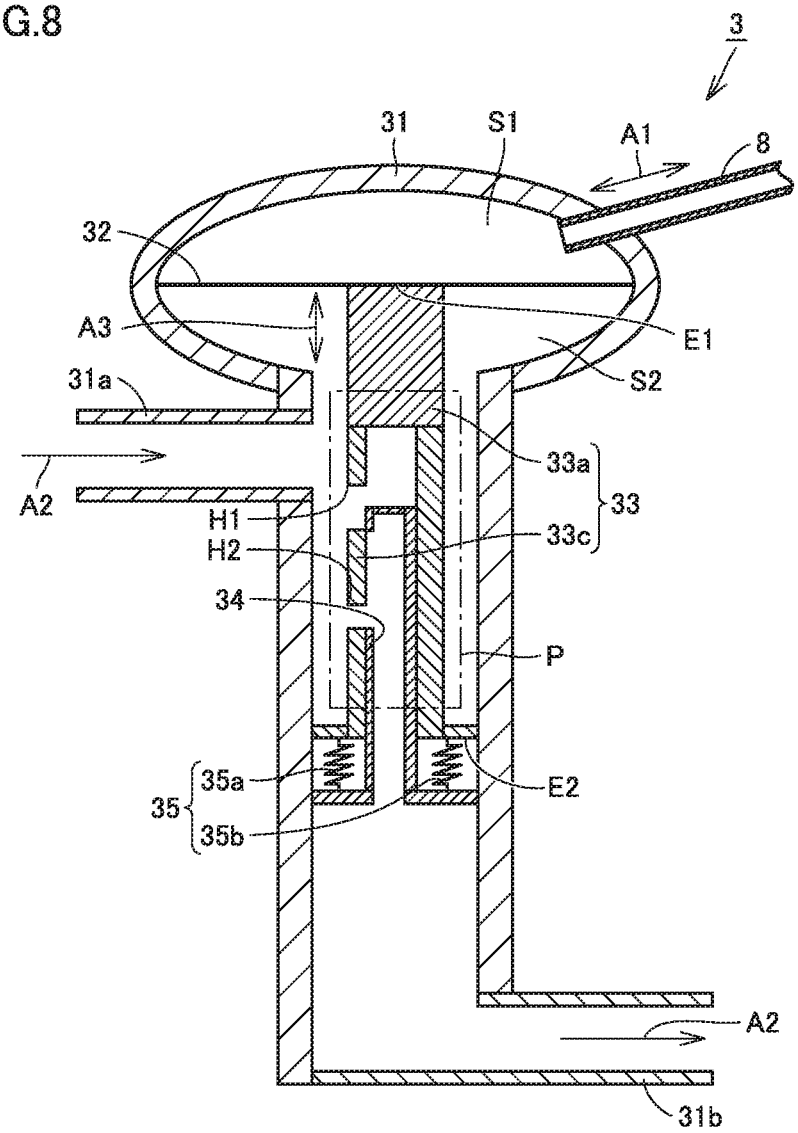
FIG. 8 is a cross sectional view schematically showing a structure of the expansion valve of an air conditioner in the second embodiment of the present invention.

Referring to FIGS. 7 and 8, in a second embodiment of the present invention, expansion valve 3 has a different configuration when compared with that in the first embodiment described above.

In the first embodiment, expansion valve 3 in which the temperature of the refrigerant detected by temperature detection unit 7 and the flow rate coefficient (Cv value) have linearity is used. Expansion valve 3 of the second embodiment is configured such that, when valve body 33 moves to a predetermined position, a flow rate coefficient (Cv value) changes in a stepwise manner.

In expansion valve 3 of the present embodiment, valve body 33 has shaft portion 33*a* and a tubular portion 33*c*. Tubular portion 33*c* has a circumferential wall, an internal space surrounded by the circumferential wall, and a first hole H1 and a second hole H2 provided in the circumferential wall. Second hole H2 has an opening area smaller than that of first hole H1. First hole H1 and second hole H2 communicate with the internal space. Valve seat 34 is inserted into the internal space of tubular portion 33*c* from second end E2. Valve seat 34 extends in axial direction A3. Expansion valve 3 is configured such that the refrigerant flows from inflow portion 31*a*, through one of first hole H1 and second hole H2, to outflow portion 31*b*. Spring 35 has a first spring 35*a* and a second spring 35*b*. First spring 35*a* and second spring 35*b* are connected to second end E2 of valve body 33 and a bottom portion of valve seat 34.

Figure 9:
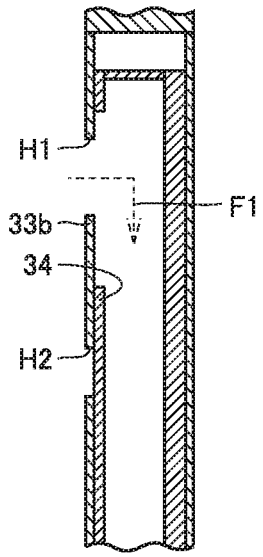
FIG. 9 is an enlarged view showing a P portion in FIG. 8, and is a cross sectional view for illustrating a first flow path.
Figure 10:
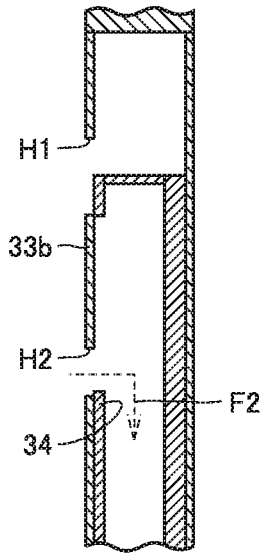
FIG. 10 is an enlarged view showing the P portion in FIG. 8, and is a cross sectional view for illustrating a second flow path.

Referring to FIGS. 8 to 10, expansion valve 3 has a first flow path F1 and a second flow path F2. Referring to FIGS. 8 and 9, first flow path F1 is a flow path extending from inflow portion 31*a*, through first hole H1, to outflow portion 31*b*. First flow path F1 has a higher refrigerant flow rate and a higher flow rate coefficient (Cv value). Referring to FIGS. 8 and 10, second flow path F2 is a flow path extending from inflow portion 31*a*, through second hole H2, to outflow portion 31*b*. Second flow path F2 has a flow rate lower than that of first flow path F1. Second flow path F2 has a lower refrigerant flow rate and a lower flow rate coefficient (Cv value).

Referring to FIGS. 9 and 10, expansion valve 3 is switched to first flow path F1 when the temperature of the refrigerant detected by temperature detection unit 7 rises, and is switched to second flow path F2 when the temperature of the refrigerant detected by temperature detection unit 7 falls. Specifically, as shown in FIG. 7, switching between first flow path F1 and second flow path F2 is performed at a predetermined temperature A (for example, an outdoor air temperature of 35° C. based on the ISO standard).

In air conditioner 10 of the present embodiment, expansion valve 3 is switched to first flow path F1 when the temperature of the refrigerant detected by temperature detection unit 7 rises, and is switched to second flow path F2 when the temperature of the refrigerant detected by temperature detection unit 7 falls. Accordingly, switching between first flow path F1 and second flow path F2 can be performed based on the temperature of the refrigerant detected by temperature detection unit 7.

Further, in air conditioner 10 of the present embodiment, since the flow rate coefficient (Cv value) can be increased in a case where the outdoor air temperature or condensation temperature reaches a temperature at which the discharge temperature may exceed an upper limit temperature of compressor 1, for example, operation can be performed with the refrigerant at an inlet of compressor 1 being in a gas-liquid two-phase state. Accordingly, the discharge temperature is decreased, and thus operation can be safely performed.

Further, in air conditioner 10 of the present embodiment, since valve body 33 is processed easier than ordinary valve bodies, the cost of expansion valve 3 can be reduced. Therefore, the cost of air conditioner 10 can also be reduced.

Further, an ordinary air conditioner is provided with a mechanism which can change the rotation number of a fan of a condenser blower in order to control the condensation temperature. For example, a DC fan is mounted. Generally, in a case where the discharge temperature increases, operation of decreasing the condensation temperature by increasing the rotation number of the fan of the condenser blower is performed in order to protect a compressor. In contrast, in the present embodiment, since operation with an increased flow rate coefficient (Cv value) can be performed in a case where the discharge temperature increases, the refrigerant at the inlet of compressor 1 enters a gas-liquid two-phase state, and the discharge temperature is decreased. Accordingly, expansion valve 3 can compensate the operation of protecting condenser blower 5. Consequently, air conditioner 10 of the present embodiment is useful in a case where the rotation number of fan 5*a* of condenser blower 5 is a constant speed.

Figure 11:
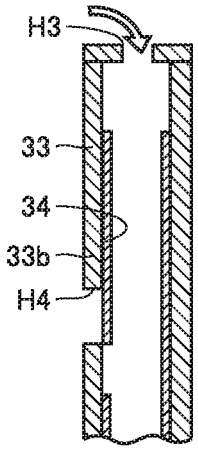
FIG. 11 is a cross sectional view for illustrating a state where refrigerant flows through a third hole of an expansion valve in a variation of the second embodiment of the present invention.
Figure 12:
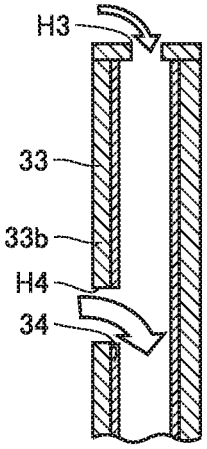
FIG. 12 is a cross sectional view for illustrating a state where the refrigerant flows through the third hole and a fourth hole of the expansion valve in the variation of the second embodiment of the present invention.

Further, valve body 33 and valve seat 34 are not limited to the above configurations, and they only have to be configured to switch a flow path and change the flow rate coefficient (Cv value). Referring to FIGS. 11 and 12, a variation of the present embodiment will be described. In this variation, valve body 33 has a third hole H3 and a fourth hole H4. Third hole H3 is provided in an upper portion of valve body 33. Third hole H3 is configured such that the refrigerant can always flow therethrough. In a case where the refrigerant flows through only third hole H3, the refrigerant flow rate is decreased, and the flow rate coefficient (Cv value) is decreased. Fourth hole H4 is provided in a side portion of valve body 33. Fourth hole H4 is configured such that the refrigerant flows therethrough when valve body 33 moves down. In a case where the refrigerant flows through fourth hole H4 in addition to third hole H3, the refrigerant flow rate is increased, and the flow rate coefficient (Cv value) is increased.

Third Embodiment

Figure 13:
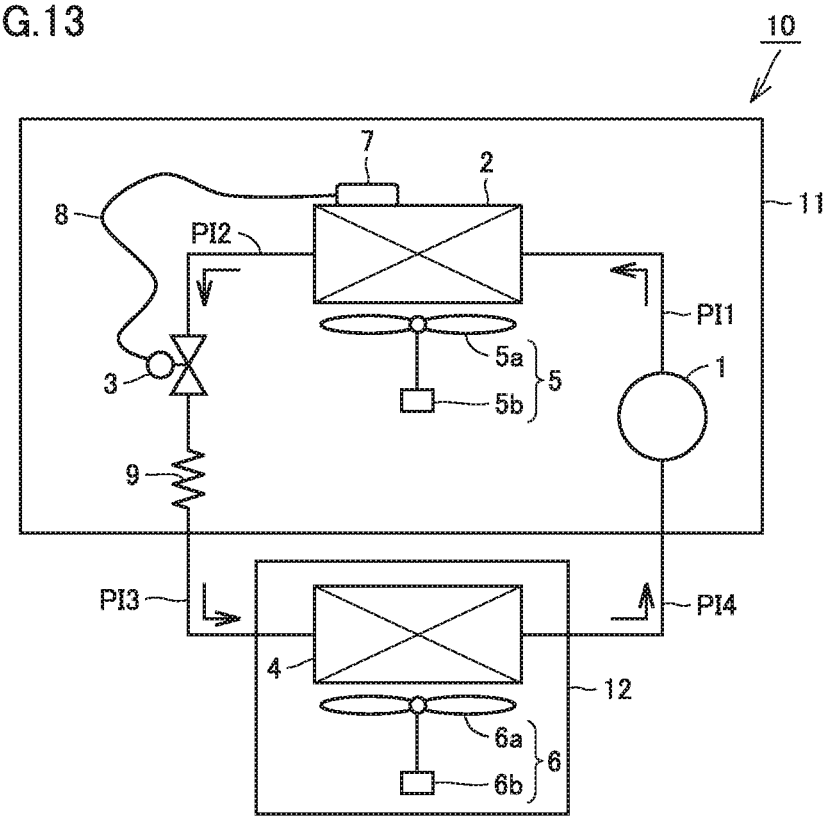
FIG. 13 is a view schematically showing a structure of a refrigeration cycle of an air conditioner in a third embodiment of the present invention.

Referring to FIG. 13, air conditioner 10 of a third embodiment of the present invention is different from air conditioner 10 of the first embodiment described above in that the former has a capillary 9.

Air conditioner 10 of the present embodiment further includes capillary 9. Capillary 9 is connected to expansion valve 3 and evaporator 4. Accordingly, the refrigerant can be condensed by capillary 9.

Since capillary 9 is placed after expansion valve 3, a minimum throttle amount can be secured by capillary 9 even in a case where expansion valve 3 has a failure. For example, in a case where expansion valve 3 has a failure and a flow rate coefficient (Cv value) is fixed at a high value although a required flow rate coefficient (Cv value) is low, the refrigerant flows at a higher flow rate, and thus the refrigerant enters a gas-liquid two-phase state at the inlet of compressor 1. In the present embodiment, since capillary 9 is provided after expansion valve 3, operation can be performed in a state minimally throttled by capillary 9. Consequently, safety of compressor 1 can be secured even in the case where expansion valve 3 has a failure.

It should be understood that the embodiments disclosed herein are illustrative and non-restrictive in every respect. The scope of the present invention is defined by the scope of the claims, rather than the description above, and is intended to include any modifications within the scope and meaning equivalent to the scope of the claims.

REFERENCE SIGNS LIST

1: compressor; 2: condenser; 3: expansion valve; 4: evaporator; 5: condenser blower; 6: evaporator blower; 7: temperature detection unit; 8: tube; 9: capillary; 10: air conditioner; 11: outdoor unit; 12: indoor unit; 31: case; 31*a*: inflow portion; 31*b*: outflow portion; 32: diaphragm; 33: valve body; 33*a*: shaft portion; 33*b*: tapered portion; 33*c*: tubular portion; 34: valve seat; 35: spring; F1: first flow path; F2: second flow path.

The invention claimed is:

1. An air conditioner comprising:

a compressor configured to compress refrigerant, a rotation number of the compressor being variably controllable;

a condenser configured to condense the refrigerant compressed by the compressor;

an expansion valve configured to decompress the refrigerant condensed by the condenser;

an evaporator configured to evaporate the refrigerant decompressed by the expansion valve; and a temperature detection unit configured to detect a temperature of the refrigerant, wherein the expansion valve has a case, a diaphragm, a valve body connected to the diaphragm, and a valve seat attached inside the case, the case has a first chamber and a second chamber partitioned by the diaphragm, the first chamber is configured such that the refrigerant enclosed in the temperature detection unit flows into and out the first chamber, the second chamber houses the valve body and the valve seat and is configured such that the refrigerant condensed by the condenser flows into the second chamber, the diaphragm is configured such that the diaphragm is deformed by a differential pressure between a pressure of the first chamber, which is an internal pressure of the temperature detection unit and a pressure of the second chamber, which is a pressure of the refrigerant condensed by the condenser, the expansion valve is configured to be capable of adjusting a flow rate per unit time of the refrigerant flowing through the expansion valve by adjusting a degree of opening of the expansion valve by movement of the valve body due to deformation of the diaphragm, the expansion valve being a temperature-type expansion valve, the temperature detection unit is a temperature sensitive cylinder, the temperature sensitive cylinder is housed in an outdoor unit, and the degree of opening of the expansion valve is increased when the temperature of the refrigerant detected by the temperature detection unit rises, and the degree of opening of the expansion valve is decreased when the temperature of the refrigerant detected by the temperature detection unit falls.

2. The air conditioner according to claim 1, wherein a flow rate coefficient of the expansion valve is increased when the temperature of the refrigerant detected by the temperature detection unit rises, and the flow rate coefficient of the expansion valve is decreased when the temperature of the refrigerant detected by the temperature detection unit falls.

3. The air conditioner according to claim 1, wherein the expansion valve includes a first flow path, and a second flow path having a flow rate lower than that of the first flow path, and the expansion valve is switched to the first flow path when the temperature of the refrigerant detected by the temperature detection unit rises, and is switched to the second flow path when the temperature of the refrigerant detected by the temperature detection unit falls.

4. The air conditioner according to claim 1, further comprising a capillary, wherein the capillary is connected to the expansion valve and the evaporator.

5. The air conditioner according to claim 1, wherein the temperature detection unit is configured to detect the temperature of the refrigerant in a state before the refrigerant is condensed and liquefied in the condenser.

* * * * *